United States Patent [19]

MacLean et al.

[11] Patent Number: 4,541,627

[45] Date of Patent: Sep. 17, 1985

[54] EXERCISE ROWING MACHINE

[76] Inventors: W. Douglas MacLean, 4532 193rd Pl. SE., Issaquah, Wash. 98027; Robert A. Rasmussen, 20820 NE. 42nd St., Redmond, Wash. 98052

[21] Appl. No.: 518,378

[22] Filed: Jul. 29, 1983

[51] Int. Cl.[4] ..... A63B 21/00; A63B 69/06

[52] U.S. Cl. ..... 272/72

[58] Field of Search ..... 272/72, 73, 120, 121, 272/126, 130, 131, 97; 104/107–109, 95; 128/25 R

[56] References Cited

U.S. PATENT DOCUMENTS

| | | | |
|---|---|---|---|
| D. 268,194 | 3/1983 | Smith | D21/195 |
| 460,959 | 10/1891 | Ferris | 104/107 |
| 660,999 | 10/1900 | Richard | 104/109 |
| 1,178,196 | 4/1916 | Willard | 104/107 |
| 1,945,332 | 1/1934 | Robinson | 104/108 |
| 3,770,267 | 11/1973 | McCarthy | 272/72 |
| 3,985,082 | 10/1976 | Barac | 128/25 R |
| 4,305,578 | 12/1981 | Disbrow et al. | 272/73 |

*Primary Examiner*—Richard J. Apley
*Assistant Examiner*—S. R. Crow
*Attorney, Agent, or Firm*—Seed and Berry

[57] ABSTRACT

An exercise rowing machine has a tubular center rail of generally rectangular shape secured to underlying frame members by carriage bolts that have their head slide-mounted in a T-slot formed on the underside of the rail. The rail is formed with side channel tracks for the rollers of the seat carriage. End plates on the rail serve as travel stops for the seat carriage and are mounted by screws passing into longitudinal grooves formed on the inside of the rail. A timer is housed in the rail.

12 Claims, 6 Drawing Figures

EXERCISE ROWING MACHINE

TECHNICAL FIELD

The present invention relates to exercise rowing machines of the type in which a seat carriage rolls back along a center rail as the exerciser pushes back on his legs and pulls back rowing arms to overcome a resisting load exerted by cylinder units extending between the rowing arms and underlying frame members to which the center rail is connected. More particularly, the invention is directed to an improved rail and manner of connecting the rail to the frame and retaining the seat carriage on the rail.

BACKGROUND ART

Heretofore, the center rail of rowing machines of the type to which this invention is directed has been connected to the underlying frame members by weld connections and the seat carriage has not only had sets of support rollers on each side tracking on the rail but also has required use of retaining rollers to keep the carriage on the rail.

DISCLOSURE OF INVENTION

In carrying out the present invention, an aluminum extrusion is used for the center rail. This extrusion is formed with longitudinal side channels each serving as a track for a respective pair of support rollers provided by the seat carriage which straddles the rail. The lower flanges of the side channels support the weight of the exerciser and upper flanges thereof retain the seat carriage. Preferably, the opposed faces of the flanges are concave and the carriage wheels have convex rims to keep the carriage centered relative to the rail.

The underside of the rail is formed with a longitudinal T-slot to receive the head and flat-sided neck of carriage bolts used to connect the rail to the frame members. Engagement of the flats on the neck of the bolts with the faces on the opposite sides of the entry of the T-slot prevents turning of the bolts relative to the rail while nuts are applied to the carriage bolts and tightened to securely clamp the rail and frame members together. End plates on the rail are secured by screws threaded into longitudinal grooves formed at the inside corners of the rail.

A timer is housed in the forward end portion of the center rail and has a shaft passing upwardly through a slot in the upper wall of the rail. The slot is hidden by a cover strip having time-indicating indicia with which a pointer knob on the timer shaft registers.

BEST MODE FOR CARRYING OUT THE INVENTION

Figure 1:
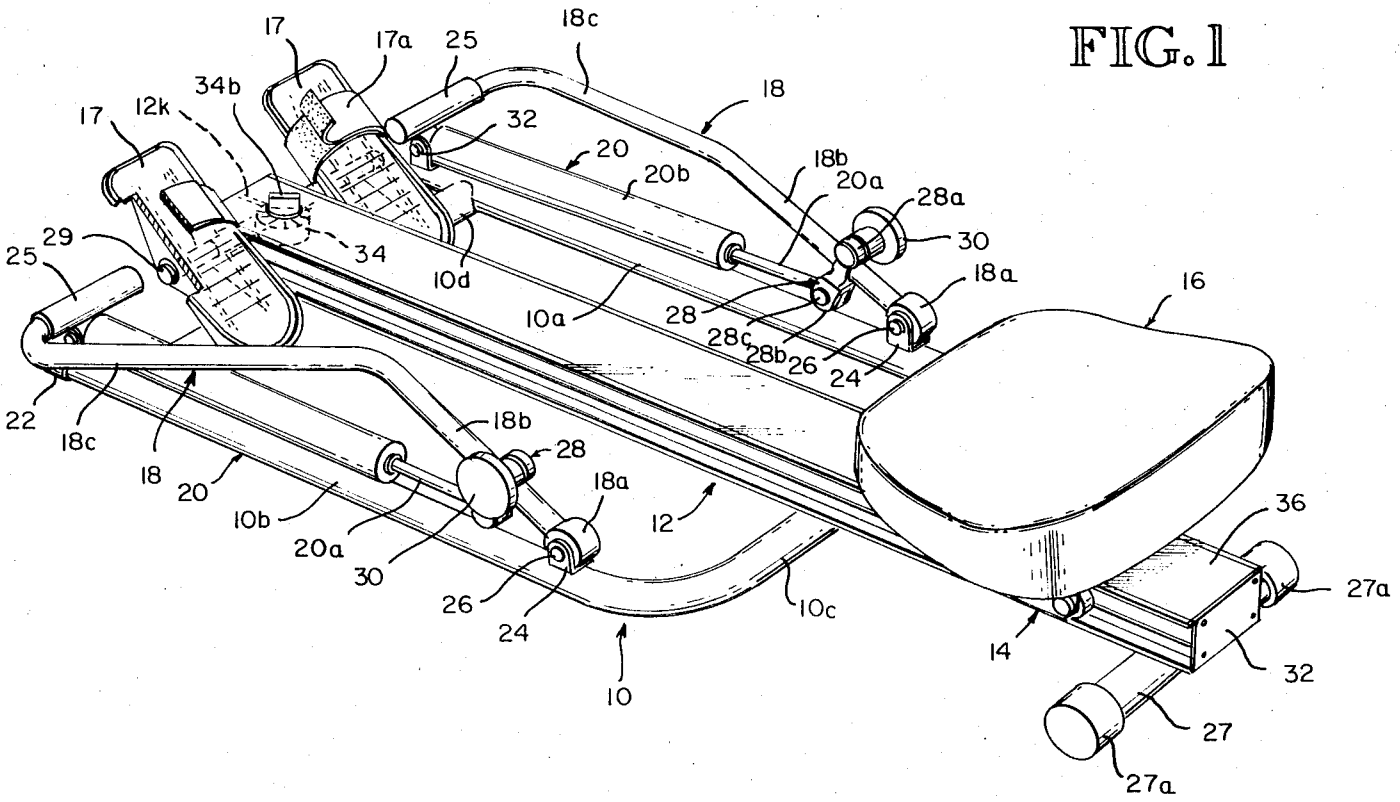
FIG. 1 is a perspective view of a rowing machine embodying the present invention.
Figure 2:
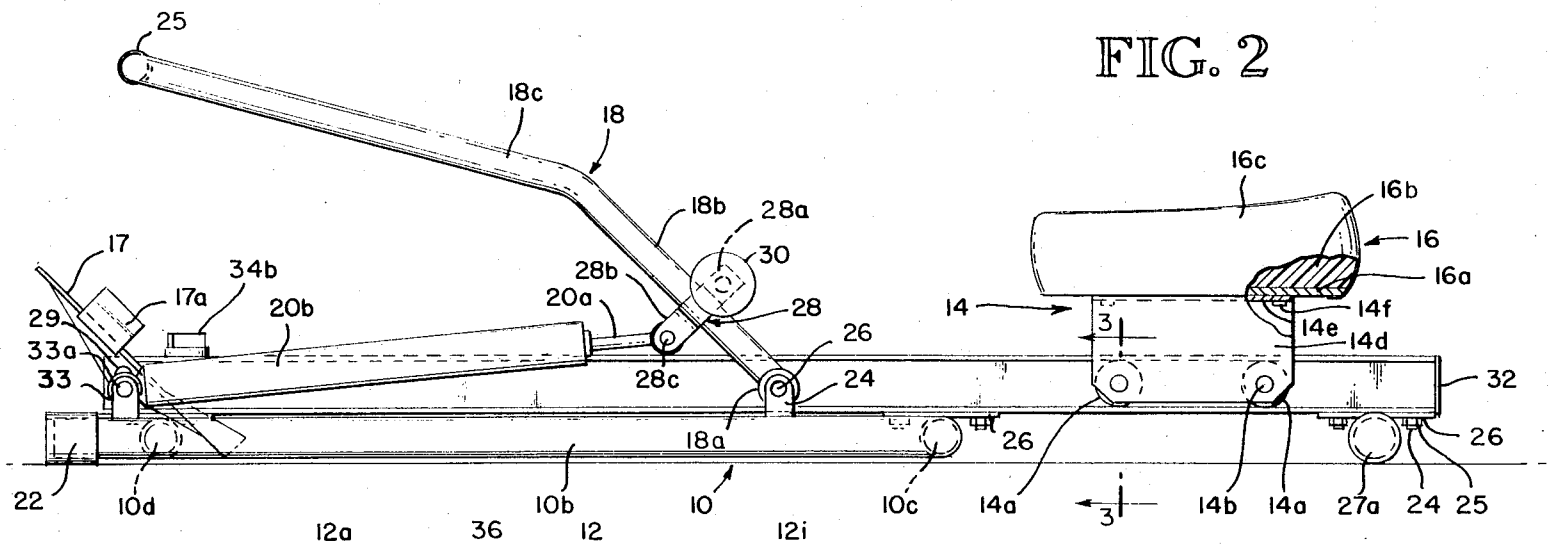
FIG. 2 is a side elevational view of the rowing machine with part of the seat assembly broken away.

Referring to the drawings, it is seen that the rowing machine of the present invention has a frame 10, a center longitudinal rail 12, a seat carriage 14 for a seat 16, and pairs of foot plates 17, rowing arms 18 and cylinder units 20 at opposite sides.

The frame 10 is fabricated from tubular stock and comprises a unitary U-shaped member providing a pair of longitudinal legs **10*a*–10*b* connected at the rear by a cross-member 10*c*. A front cross-member 10*d* is welded at its ends to legs 10*a*–10*b* a short distance behind the free forward ends of the legs so that these ends project as feet forwardly of the cross-member 10*d* to receive rubber caps 22**.

The rowing arms 18 are also of tubular stock and have bosses **18*a* at one end pivotally connected at their lower ends to fork units 24 welded to the frame legs 10*a*–10*b* adjacent the rear cross-member 10*c*. The bosses 18*a* contain bearings which receive a connecting pin 26 passing through the fork units 24. From the bosses 18*a*, the rowing arms 18 have straight adjustment sections 18*b* to receive adjustment clamp units 28, each providing a split adjustment collar 28*a* which is selectively pinched into fixed position by a locking screw having a knob head 30 and providing a fork 28*b* which is pivotally connected at pin 28*c* to the piston rod 20*a* of the respective cylinder unit 20. The cylinder units are pivotally connected to forks 32 welded to the frame legs 10*a–b* near the front cross-member 10*d*. Forwardly of the adjustment sections 18*b*, the rowing arms bend at an obtuse angle and slope outwardly along sections 18*c* to inwardly projecting handle portions having handle grips 25** sleeved thereon.

Figure 3:
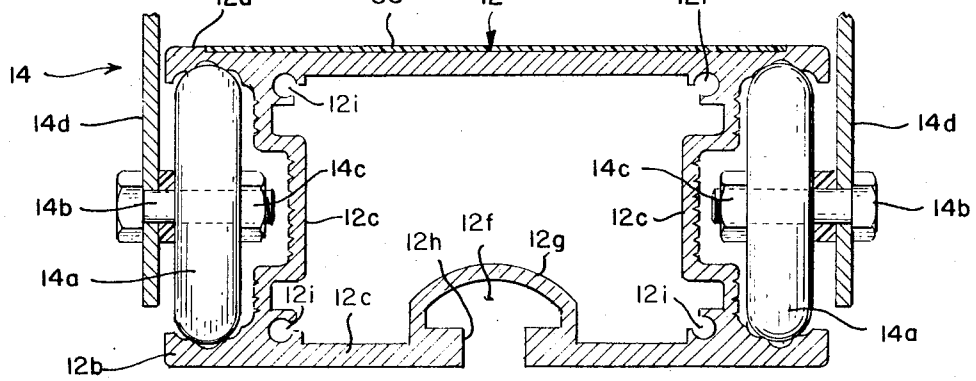
FIG. 3 is an enlarged transverse cross-sectional view taken as indicated by line 3—3 in FIG. 2.
Figure 4:
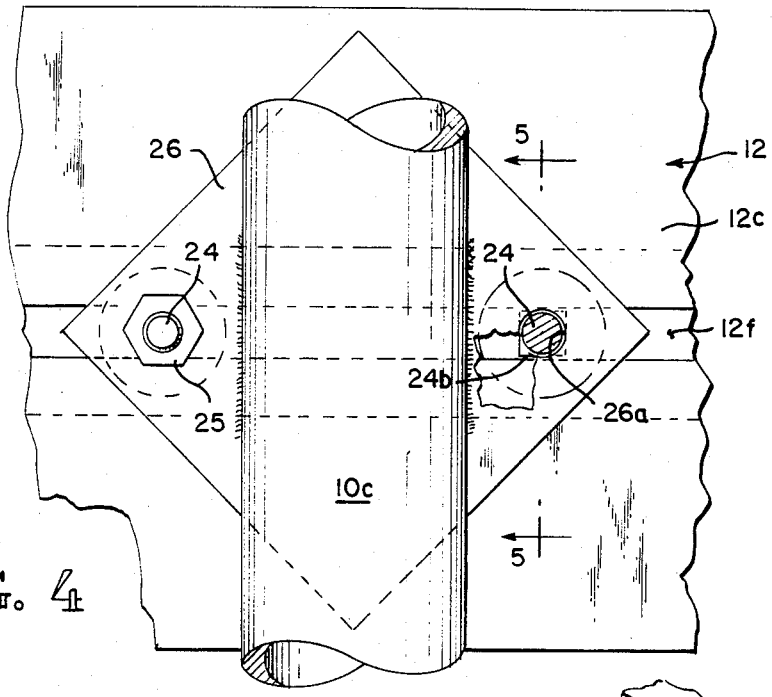
FIG. 4 is a fragmentary bottom detail view showing the bolt connection between the center rail and one of the underlying frame members.

Directing attention to FIG. 3, the center rail 12 is preferably an aluminum extrusion having a generally rectangular configuration in cross-section but with lateral flange extensions **12*a*–12*b* top and bottom at both sides to provide side channel tracks for pairs of seat carriage rollers 14*a*. It is preferred that the rollers 14*a* have rounded convex rims and that the opposing faces of the track flanges 12*a–b* be concave so as to mate with the rollers 14*a* and keep them in proper position. The rollers 14*a* have bearings journaled on inwardly projecting shaft bolts 14*b* having their threaded inner ends and associated nuts 14*c* received in longitudinal grooves formed by channel portions 12*c* in the lateral sidewalls of the center rail. The shaft bolts 14*b* pass through cheek plates 14*d* which straddle the rail 12 and form a U-shape with an integral mounting plate 14*e* to which the seat 16 is attached. The seat 16 has a plywood base 16*a*, a resilient pad 16*b*, and a durable cover 16*c* extending over the pad and stapled to the underside of the base. Wood screws 14*f* pass through holes in the mounting plate 14*e* and into the seat base 16*a***.

Figure 5:
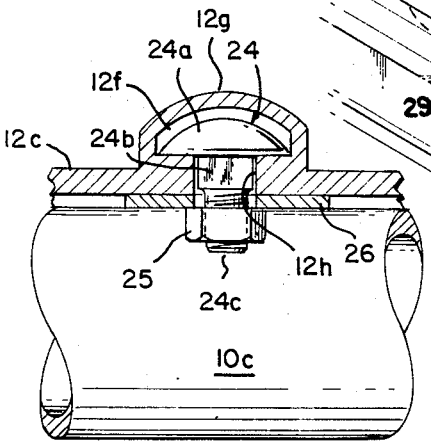
FIG. 5 is a detail cross-sectional view through one of the bolt connections and taken as indicated by line 5—5 in FIG. 4.

As part of the present invention, the bottom wall **12*e* of the center rail 12 is formed with a T-slot 12*f* to receive and retain carriage bolts 24, as shown in FIG. 5. Such bolts typically have rounded heads 24*a* and flat-sided necks 24*b* of square cross-section followed by round threaded shanks 24*c*. The T-slot 12*f* has a curved dome 12*g* generally conforming with the shape of the bolt heads 24*d* and has flat entry faces 12*h* to oppose the flats of the bolt necks 24***b* and prevent the bolts 24 from turning relative to the rail 12.

The threaded shanks 24*c* of the carriage bolts 24 extend through mounting holes 26*a* formed at two diagonally opposite end portions of three square mounting plates 26. Two of these plates are welded to the center portions of the frame cross-members 10*c–d*, and the third is welded to a rear independent tubular cross-member 27 with rubber end caps 27*a*. This cross-member 27 supplements the frame 10 to provide a firm, level ground support for the rail 12. When nuts 25 on the carriage bolts 24 are tightened, the upper faces of the mounting plates 26 are pulled snugly against the underside of the rail 12 to thereby firmly secure the rail 12 to the frame rod and rear cross-member 27.

Figure 6:
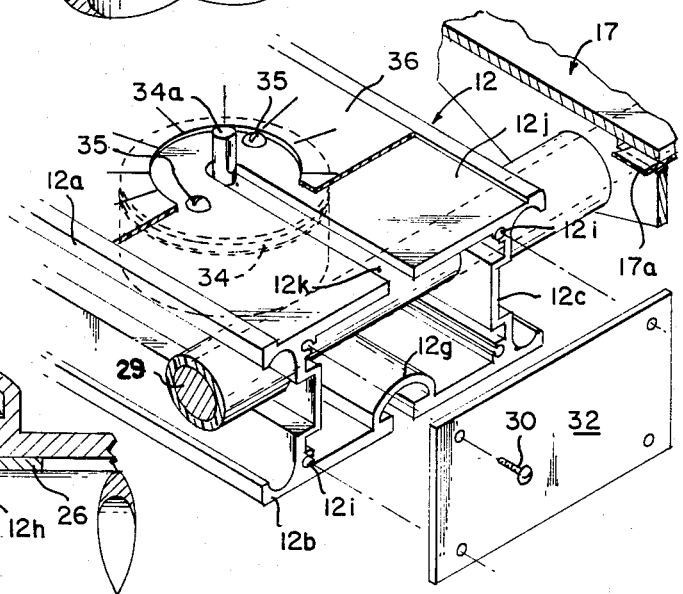
FIG. 6 is an exploded detail perspective view showing the forward end portion of the center rail and associated elements.

It will be noted from FIGS. 1 and 6 that a cross-shaft 29 passes through the sidewalls of the rail 12 near the forward end thereof and through mounting flanges cast as downward extensions on the underside of the foot-plates 17. Snap-on end caps retain the cross-shaft 28. With this arrangement, the foot plates 17 are free to swing up and down relative to the rail 12. Adjustable foot straps 17*a* are provided on the foot plates.

The rail 12 is preferably also formed with four inner longitudinal grooves 12*i* at its four corners, each of which encompasses about 270 degrees. These grooves 12*i* are designed to receive self-tapping screws 30 for holding end cover plates 32 in position at the ends of the rail 12. The rear cover plate 32 serves as a stop to limit rearward travel of the seat carriage 14 along the rail 12.

The rowing machine is preferably provided with a spring-powered timer 34 housed within the forward end of the center rail 12 and held in place by a pair of screws 35. This timer has a shaft 34*a* at the top with a removable pointer knob 34*b* covering the screws 35. Hand-turning of the knob 34*b* sets (winds) the timer, and the shaft turns (unwinds) responsive to the passage of time. To accommodate the shaft 34*a*, the upper wall 12*j* has a slot 12*k* so that, during assembly, the time 34 can be moved endwise along the rail into position before the front end plate 32 is attached. The upper wall 12*j* of the rail is preferably recessed slightly at the top to provide a shallow channel with side edges 12*k* to receive a decal strip 36 secured to the rail 12 by a suitable adhesive. This strip 36 hides the slot 12*k* and is imprinted with radiating, time-indicating indicia 38 surrounding the timer knob 34*b*. Holes are provided in the strip 36 for passage of the timer shaft 34*a* and screws 35. The trademark and other information, together with decorative graphics, can be printed on the strip 36 if desired.

From the foregoing description, it will be appreciated that the seat carriage 14 and seat 16 can be easily assembled with the rail 12 while the rear end plate 32 is removed merely by introducing the rollers 14*a* into the rear ends of the channels at both sides of the rail formed by the flanges 12*a–*12*b*. The end plate 32 can then be easily applied by screwing the fasteners 30 into the rear end of the grooves 12*i*. This ease of assembly makes it practical to package the rowing machine with the seat carriage 14 and seat 16 separated from the rest of the machine in a suitable carton, thereby permitting the carton to be smaller than if the machine were entirely preassembled.

The arrangement of rollers 14*a* and side track channels has the advantage that there need not be more than two rollers on each side to both carry the load of the rower and prevent separation of the seat carriage 14 from the rail 12. The concave inner faces of the rail flanges 12*a–*12*b* combined with the concave rims of the rollers 14*a* so confine the rollers as to keep the seat carriage from shifting sideways relative to the rail 12.

When assembling the rail 12 with the frame 10 and cross-member 27, the worker can place the rail upside down on a work table and slide six carriage bolts 24 upside down along the T-slot 12*f* until the bolts are in approximately the proper position. Then the frame 10 and cross-member 27 can be lowered to pass the upwardly projecting threaded ends of the bolts through the respective holes 26*a* in the mounting plates 26. Following this, the nuts 25 can be applied and wrench-tightened on the bolts 24 without the bolts responsively turning relative to the rail 12 because of engagement of the flat faces 24*b* of the bolts with the entry faces 12*h* of the T-slot 12*f*.

While the preferred embodiments have been illustrated and described, it will be understood that variations will be apparent to one of ordinary skill in the art. Accordingly, the invention is not to be limited to the specific embodiments illustrated in the drawings.

We claim:

1. In combination, an elongated, generally rectangular, tubular rail for an exercise rowing machine formed with outwardly opening channels at opposite sides to provide a laterally spaced pair of roller tracks, and formed at the bottom with an externally exposed, longitudinal T-slot open at the ends for receiving the head and neck of bolts projecting from the rail to make connection with frame members, said rail having a longitudinal slot in its top wall extending from one end of the rail a minor part of the length of the rail, a seat carriage with rollers tracking on the tracks, a timer housed within said rail and having a shaft projecting through said slot, said shaft having a pointer knob on its free end; and rowing arm means operatively associated with said rail.

2. A combination according to claim 1 in which a cover member is secured to the top wall of the rail and covers said slot, said cover member having time-indicating indicia adjacent the pointer knob.

3. In an exercise rowing machine, a frame assembly including an elongated, generally rectangular, tubular rail member formed with laterally projecting roller guide tracks along its length for a seat carriage and formed with a longitudinal T-slot along its length which is exposed at the bottom of the rail member and has open ends;

same frame assembly also including a bottom support frame unit beneath the rail member;

bolts each having an enlarged head retained by said T-slot and having a shank passing downwardly through said support frame unit, said bolts being adapted to be inserted into said T-slot only at its open ends; and rowing arm means pivotally connected to said frame assembly.

4. In an exercise rowing machine according to claim 3, mounting plates provided by said support frame unit and having said bolt shanks passing through holes in the mounting plates; and nuts threaded onto said bolt shanks and engaging the underside of said mounting plates.

5. In an exercise rowing machine according to claim 3, front and back lateral members of tubular stock provided by said support frame unit;

mounting plates fixed to the top of said lateral members and each having a pair of holes therethrough positioned forwardly and rearwardly of the respective lateral member, said bolt shanks passing downwardly through said holes; and nuts threaded onto said bolt shanks and engaging the underside of said mounting plates, whereby the rail member is secured to the support frame.

6. An exercising rowing machine comprising:

a frame assembly including a ground support structure and a central, longitudinal hollow rail of extruded aluminum resting on said support structure and presenting a bottom longitudinal T-slot along its length;

a seat carriage mounted to roll along said rail above said support structure;

said ground support structure including a rigid frame which is generally rectangular in plan view and has fixed thereon front and back mounting plates each having a pair of holes therethrough;

a respective pair of carriage bolts for each pair of holes, each bolt having its head retained in said T-slot and having its shank kept from turning by the T-slot and extending through the respective hole, said bolts being adapted to be inserted into the T-slot only at an end of the T-slot; and nuts on the bolts and bearing against the underside of the mounting plates;

and rowing arm means pivotally connected to said frame assembly.

7. An exercise rowing machine according to claim 6 in which said frame is made of round tubular stock and said mounting plates are welded thereto, each mounting plate being of generally rectangular configuration and having one of its diagonals parallel to said rail, the respective pair of holes in each mounting plate being spaced apart along said one diagonal a distance greater than the diameter of said tubular stock.

8. In an exercise rowing machine:

an elongated, generally rectangular, tubular rail member formed with outwardly opening, longitudinal channels at two opposite sides to serve as roller tracks, said channels each having top and bottom concave faces;

a seat carriage straddling said rail member from above and having a set of convex rollers on each side tracking on said roller track between said concave faces for fully supporting the seat carriage;

roller stops on the ends of the rail member covering the ends of the roller tracks;

rowing arm means operatively associated with said rail; and a support frame beneath the rail member and secured thereto such that said seat carriage is free to roll along the roller tracks between said roller stops.

9. In an exercise rowing machine:

a seat carriage with rollers;

a frame assembly including an elongated tubular track rail formed with laterally spaced roller tracks supporting the rollers of the seat carriage and formed with a bolt-retaining T-slot along its length which is exposed at the ends of the member;

said frame assembly also including a sub-frame means engaging the track rail;

bolts retained by the T-slot and extending into the sub-frame means; and rowing arm means pivotally connected to said frame assembly.

10. In an exercise rowing machine:

a seat carriage with rollers;

a frame including an elongated tubular member formed with roller tracks at opposite sides supporting the rollers of the seat carriage, and formed with longitudinal grooves exposed to the inside thereof and having a circumference more than a halfcircle;

an end plate on the member in the path of the carriage;

screws passing through the end plate into one end of the grooves to secure the end plate to the member; and rowing arm means pivotally mounted on the frame assembly.

11. In an exercise rowing machine:

a frame assembly including a tubular rail member formed along its length with a top wall, a bottom wall, a pair of side walls, a pair of track flanges at opposite sides, and a pair of retaining flanges at opposite sides;

a seat carriage having a seat support frame straddling the rail member and supported by two pairs of rollers tracking on the track flanges and closely underlying the retaining flanges;

said rail member also being formed with a T-slot along its length;

said frame assembly including sub-frame means engaging said rail member at opposite sides of the T-slot;

fasteners retained by the T-slot and connected to the sub-frame means, said fasteners being shaped to pass into the T-slot only through an end of the T-slot; and rowing arm means pivotally mounted on the top frame assembly.

12. An exercise rowing machine comprising:

a frame assembly including a tubular rail member formed uniformly along its length with a top wall, a bottom wall, a pair of side walls, a pair of track flanges at opposite sides adjacent the bottom wall, and a pair of retaining flanges at opposite sides adjacent the top wall;

a seat carriage having a seat support frame straddling the rail member and supported by two laterally spaced pairs of support rollers, one pair at each side of the seat support frame, which track on the track flanges and closely underlie the retaining flanges, said roller and track flanges interfitting to keep the seat carriage tracking in a straignt path relative to the rail member, and said retaining flanges keeping the carriage from separating from the rail members;

said frame assembly also including ground support means secured to the rail member in engagement with said bottom wall and cleared by the seat carriage;

foot rest means on the frame assembly near one end of the rail member;

stop means near the other end of the rail member and blocking the travel path of the rollers; and rowing arm means pivotally mounted on the frame assembly.

* * * * *